United States Patent [19]

Chuiko et al.

[11] Patent Number: 4,540,652

[45] Date of Patent: Sep. 10, 1985

[54] MATERIAL FOR THE ELECTROSTATIC DATA RECORDING CONTAINING SILICON AND TITANIUM OXIDES

[76] Inventors: Alexei A. Chuiko, ulitsa Saxoganskogo 43, kv. 26, Kiev; Anatoly V. Morev, ulitsa Zhdanova, 19, kv. 27; Alexandr S. Golovkov, Institutsky proezd, 2, kv. 94, both of poselok Pravdinsky, Moskovskaya oblast; Valentin A. Smirnov, prospekt 50-letia SSSR, 17a, kv. 32, Kaunas; Evgeny F. Voronin, ulitsa Entuziastov, 29/2, kv. 49, Kiev; Raisa A. Evlakhova, ulitsa Chernyakhovskogo, 88a, Kaunas; Galina Y. Guba, prospekt Nauki 142/1, korpus 14, kv. 13/5, Kiev; Iolita R. Slushnene, ulitsa Chernyakhovskogo, 88a; Arunas V. Pasvyanskas, ulitsa Chernvakhovskogo, 19, kv. 20, both of Kaunas; Roman V. Sushko, ulitsa Khnelnitskogo, 17, kv. 29, kalush, Ivano-Frankovskaya oblast, all of U.S.S.R.

[21] Appl. No.: 613,891

[22] Filed: May 24, 1984

[30] Foreign Application Priority Data

May 24, 1983 [SU] U.S.S.R. ..... 3596199

[51] Int. Cl.[3] ..... G03G 5/087

[52] U.S. Cl. ..... 430/84; 430/96; 106/308 Q

[58] Field of Search ..... 430/96, 84; 106/308 Q

[56] References Cited

U.S. PATENT DOCUMENTS

Re. 31,602 6/1984 Makinen ..... 106/308 Q X

*Primary Examiner*—John D. Welsh

*Attorney, Agent, or Firm*—Burgess, Ryan & Wayne

[57] ABSTRACT

A material consists of an electrically conducting support and a dielectric layer containing in % by weight: 17–80 of a polymeric binder and 20–83 of a finely divided mixed pyrogenic silicon and titanium oxide containing between 10 and 50% by weight of titanium.

6 Claims, No Drawings

MATERIAL FOR THE ELECTROSTATIC DATA RECORDING CONTAINING SILICON AND TITANIUM OXIDES

FIELD OF THE ART

The invention relates to electrophotographic data reproduction and for converting data from a system of electric pulses into a visible image on a data carrier material.

More specifically, the invention deals with a material for electrostatic data recording.

Electrostatic recording is carried out on a material consisting of an electrically conducting support and a dielectric layer using a system of electrodes which are pressed against the surface of the dielectric layer. During recording, voltage pulses are fed to the recording electrodes which leave over on the dielectric layer a surface charge thus forming a latent electrostatic image.

After the passage through the system of electrodes the material is fed to a developing station where toner particles are deposited onto the charged zones of its surface, the toner particles being charged with the polarity which is opposite to the polarity of the electrostatic latent image. The criterion of the materials ability to form the image is its maximum charging capacity which is determined by a ratio of maximum potential of charging of the dielectric layer to its thickness in terms of volts per 1 μm of the layer thickness.

A satisfactory optical contrast of two zones of the material may be obtained with a potential difference therebetween of 1.5 to 2 V per 1 μm since spontaneous sorption of toner causes the blurring of tonality forms a background corresponding to a charging of the order of 0.5 to 1 V/μm.

For forming a half-tone image with a maximum optical density of 1.0 and gradations of optical density of the order of 0.02 (which roughly corresponds to the sensitivity of the eye of an average person), it is necessary to have a material which is capable of sensing about 50 degrees of contrast of a latent electrostatic image at 1.5 to 2 V/μm so that the material should have a maximum charging capacity of at least 75 to 100 V/μm. This charging capacity is equivalent to an electric breakthrough voltage for the majority of electrically insulating materials thus imposing stringent requirements upon the composition of the dielectric layer.

The dielectric layer comprises a polymeric binder and a pigment which is necessary for fixing toner particles during the development.

BACKGROUND OF THE INVENTION

Known in the art is a material in which the dielectric layer contains kaolin and a triple copolymer of methacrylic acid with acrylic acid esters (cf. Katahiri K., Ishikawa S., et al., Electrostatic Recording Material and Method for the Production thereof, U.S. Pat. No. 4,268,595, 1981).

In another known material, the dielectric layer contains colloidal silicon dioxide and a copolymer of methacrylic acid with a methacrylate or acrylate (cf. Kitahara M., et al., Electrostatic Recording material Having a Dielectric Copolymer Coated Layer, U.S. Pat. No. 4,097,646, 1978). The presence of a pigment with a hydrophilic surface which retains considerable quantities of absorbed water in the compositions of the dielectric layer does not permit achieving a high charging capacity and charge retention over a certain time period.

This disadvantage may be eliminated by using as a pigment of the dielectric layer a a layer of a finely divided pyrogenic silicon dioxide with the surface alkylated or modified with organosilicon compounds such as dimethyldichlorosilane, its derivatives or polymethylcyclosiloxanes (cf. USSR Inventor's Certificates No. 1 35558, Off. Bull. No. 30, 1983; No. 1004951, Off. Bull. No. 10, 1983; No. 1011576, Off. Bull. No. 14, 1983; No. 1056125, Off. Bull. No. 43, 1983, respectively).

However, owing to the fact that the surface of the pyrogenic silicon dioxide exhibits weak acceptor properties, it has a destabilizing effect on the super molecular structure of the polymeric binders used during the layer formation thus limiting the values of the basic electrophysical characteristics of the material.

Known in the art are a number of materials which comprise titanium dioxides as a pigment and a binder in the form of a mixture of phenol formaldehyde resin and vinyl acetate (cf. Brown A.D., Heights C., Blumental J., Electrographic Record System Having a Self-Spacing Medium, U.S. Pat. No. 3,711,859, 1973), a copolymer of vinyl acetate and crotonic acid (cf., Funderbark K., Receiver Sheets for Electrostatic Recording, U.S. Pat. No. 3,861,954, 1975), a mixture of a copolymer of vinyl acetate with vinyl chloride and nitrocellulose (cf. Fujie S., Miyashima T., Electrically Sensitive Paper, Japanese Pat. No. 55-33995, 1980).

These materials have a charging capacity of up to 30 to 40 V/μm, which provides for a high contrast of an image but which is insufficient for reproducing half-tones. This is due to the properties of titanium dioxide which is a semiconductor to a large extent rather than an insulator so that its bulk resistance is inadequate.

Known in the art is a material for the electrostatic data recording consisting of an electrically conducting support and a dielectric layer containing a mixed finely divided pyrogenic titanium and silicon dioxide with a titanium content between 10 and 50% by weight and a polymeric binder (cf. USSR Inventor's Certificate No. 1046736, Off. Bull. No. 37, 1983). The contents of the components in the layer in % by weight are as follows:

| | |
|---|---|
| Mixed titanium and silicon oxide | 17–75 |
| Polymeric binder | 25–83. |

The surface of the mixed oxide may be modified with a polyalkylchlorosilane or its derivatives.

The dielectric layer of this material has a charging capacity of the order of 50 to 60 V/μm so that it can be used for producing half-tone images of a moderate quality, but this charging capacity is inadequate for reproducing high-quality half-tone originals.

The charging capacity of this material is limited by the presence, on the surface of the mixed oxide used, of chemically active groups which are eventually the charge carriers. Modifying the surface of the mixed oxide with alkylchlorosilanes or their derivatives does not improve the charging capacity of the material even if such modification proved effective for pure silicon dioxide (cf. USSR Inventor's Certificate No. 1004951, No. 1011576).

OBJECT OF THE INVENTION

It is an object of the invention to provide a material for the electrostatic data recording which improves the quality of half-tone images.

SUMMARY OF THE INVENTION

This object is accomplished by use of a material for the electrostatic data recording, consisting of an electrically conducting support and a dielectric layer containing a polymeric binder and a pigment in the form of a mixed finely divided pyrogenic silicon and titanium oxide containing between 10 and 50% by weight of titanium, according to the invention, the pigment comprises said mixed finely divided pyrogenic silicon and titanium oxide containing between 10 and 50% by weight of titanium modified with a polymethylcyclosiloxane, with the following contents of the components in % by weight:

| | |
|---|---|
| Modified mixed silicon and titanium oxide | 17–80 |
| Polymeric binder | 20–83. |

The content of a polymethylcyclosiloxane on the surface of the pigment is between 7 and 10% by weight. A polymethylcyclosiloxane may be in the form of hexamethyltricyclosiloxane, octamethyltetracyclosiloxane or their mixtures.

The polymeric binder may be in the form of vinyl, acrylic, alkyd and styrene polymers or their mixtures.

The material according to the invention has a charging capacity of 100 to 120 V/μm, which makes it possible to obtain an image with 50 to 60 degrees of contrast thus corresponding to the sensitivity of the eye of an average person.

Thus, the material is suitable for the electrostatic reproduction of high-quality half-tone images.

This useful result is unexpected since one would assume, based on the information about the dielectric layers containing silicon dioxide, that the use of various organosilicon modifiers of the pigment surface can improve electrophysical properties of the material, in particular its charging capacity, by eliminating chemically active surface groups.

However, for a mixed finely divided pyrogenic silicon and titanium oxide, there is no useful result when they are modified with alkylchlorosilanes or their derivatives, whereas the result of modification with polymethylcyclosiloxanes proves much greater than one might have expected on the basis of information about experiments with modified silicon dioxide. This material improvement of the charging capacity is due to the fact that modifying the surface of mixed titanium and silicon oxide with a polymethylcyclosiloxane not only eliminates chemically active groups but also provides optimum conditions for a physico-chemical reaction of the mixed oxide with the polymeric binder owing to a certain balance between donor and acceptor properties of the surface caused by alternation of silicon and titanium atoms in the oxide structure, whereby a qualitatively homogeneous permolecular structure of the binder is obtained during the formation of the layer.

On the other hand, this balance between donor and acceptor properties of the surface of the mixed oxide limits the effect of polyalkylchlorosilanes and their derivatives on chemically active groups.

Therefore, the mechanisms of processes occurring during the modification of silicon dioxide and mixed titanium and silicon oxide with organosilicon compounds are substantially different.

This useful result can only be achieved with the proportioning of the components of the insulating layer as follows: 17 to 80% by weight of a polymeric binder, 20 to 83% by weight of said mixed silicon and titanium oxide modified with 7 to 10% by weight of a polymethylcyclosiloxane.

With a content of a polymeric binder below 17% by weight or with a content of said pigment less than 83% by weight, respectively, destruction of the layer will take place owing to a shortage of the binder thus resulting in inferior mechanical and electrophysical properties of the layer.

With a content of a polymeric binder above 80% by weight or with a content of said pigment less than 20% by weight, respectively, the layer will become varnish-like and will lose its capacity of strongly absorbing toner during development.

An optimum content of polymethylcyclosiloxanes on the surface of said mixed silicon and titanium oxide is between 7 and 10% by weight.

The content of the modifier may be outside this range, but an increase in the content of the modifier above 10% by weight is inexpedient as it would hamper its condensation during the formation of the layer which may have a negative effect on electrophysical properties of the material.

With a content of the modifier less than 7% by weight chemically active groups cannot be eliminated completely from the pigment surface which will have a negative effect on the charging capacity of the material.

DETAILED DESCRIPTION OF THE INVENTION

A material for the electrostatic data recording according to the invention is prepared in the following manner.

A suspension of components of the insulating layer in organic solvents such as cyclic hydrocarbons, alcohols, ketones and ethers is finely divided in a ball mill for one hour.

The suspension is applied to an electrically conducting support at a rate of 2 to 6 g/m$^2$ in a coating machine with dipping roll, the solvent is completely removed by drying at 105° C. for five minutes, and samples of material are conditioned at the relative air humidity of 20% during 24 hours. Then maximum charging capacity of the material samples is tested at a testing arrangement. The electrically conducting support may be in the form of paper or polymeric film to which is applied an electrically conducting polymeric coating imparting an electrical conductance of the order between $10^{-4}$ and $10^{-9}$ Siemens to the surface.

For that purpose, the material is charged with a corona discharge at a corona voltage of 10 to 12 kV and maximum charge potential is measured by a non-contact method using a dynamic electrometer; the result is divided by the thickness of the insulating layer measured by a micrometer gauge. The mixed silicon and titanium oxide containing between 10 and 50% by weight of titanium is modified with a polymethylcyclosiloxane as follows. A batch of the mixed $TiO_2$-$SiO_2$ oxide is first subjected to a heat treatment in vacuum at 200°–250° C. during one hour and is then contacted with a polymethylcyclosiloxane at 250°–500° C. for 0.5–1 hours. The reaction completion time is fixed by IR-spectroscopy. Unreacted substances and collateral reaction products are removed by a heat treatment in vacuum.

The invention will be illustrated in the following examples.

EXAMPLE 1

A material was prepared in this and other examples using the technique described below. A material for the electrostatic recording was prepared with the dielectric layer containing 20% by weight of mixed silicon and titanium oxide with the titanium content of 10% by weight, modified with hexamethyltricyclosiloxane, 60% by weight of chlorinated polyvinyl chloride and 20% by weight of a copolymer of glycerin with phthalic anhydride. The modified oxide had 7% by weight of hexamethyltricyclosiloxane on the surface. The charging capacity of the material was 127 V/μm.

EXAMPLE 2

The material was prepared with the dielectric layer containing 83% by weight of mixed silicon and titanium oxide with the titanium content of 40% by weight, modified with octamethyltetracyclosiloxane, and 17% by weight of polystyrene. The modified oxide contained 10% by weight of octamethyltetracyclosiloxane on the surface. The charging capacity of the material was 113 V/μm.

EXAMPLE 3

A material was prepared with the dielectric layer containing 51% by weight of mixed silicon and titanium oxide containing 20% of titanium, modified with a mixture consisting of (in % by weight) hexamethyltricyclosiloxane-30 and octamethyltetracyclosiloxane-70, and 49% by weight of a copolymer of butylmethacrylate with methacrylic acid.

The modified oxide contained 8.5% by weight of the mixture of the polymethylcyclosiloxanes on the surface. The charging capacity of the material was 122 V/μm.

EXAMPLE 4

(control)

A material was prepared having the dielectric layer in which a quantitative proportioning of the components was outside the claimed range.

The layer contained 10% by weight of the mixed oxide modified with hexamethyltricyclosiloxane and 90% by weight of chlorinated polyvinyl chloride.

The modified oxide contained 8% by weight of hexamethyltricyclosiloxane on the surface. The charging capacity of the material was 86 V/μm.

EXAMPLE 5

(control)

A material was prepared having the dielectric layer in which the quantiative proportioning of the components was outside the claimed range. The dielectric layer contained 85% by weight of the mixed titanium and silicon oxide modified with octamethyltetracyclosiloxane and 15% by weight of chlorinated polyvinyl chloride.

The modified mixed oxide contained 9% by weight of octamethyltetracyclosiloxane on the surface. The charging capacity of the material was 72 V/μm.

EXAMPLE 6

A material was prepared in accordance with USSR Inventor's Certificate No. 1046736 in which the dielectric layer contained 50% by weight of mixed finely divided pyrogenic silicon and titanium oxide modified with dimethylchlorosilanes and 50% by weight of a copolymer of butylmethacrylate with methacrylic acid.

The modified oxide contained 3.70% by weight of dimethylchlorosilane on the surface. The charging capacity of the material was 59 V/μm.

EXAMPLE 7

A material was prepared in accordance with U.S. Pat. No. 3,711,859. The charging capacity of the material was 38 V/μm.

The study of the results of Examples 1 through 3 shows that the electrostatic material according to the invention is suitable for the reproduction of high-quality half-tone images with the claimed proportion of the components of the dielectric layer.

What is claimed is:

1. A material for the electrostatic data recording, consisting of an electrically conducting support and a dielectric layer which contains in % by weight: 17–80 of a polymeric binder, 20–83 of a mixed finely divided pyrogenic silicon and titanium oxide containing 10–50% of titanium modified with a polymethylcyclosiloxane.

2. A material for the electrostatic data recording according to claim 1, wherein the content of a polymethylcyclosiloxane is between 7 and 10% by weight of the modified pyrogenic silicon and titanium oxide.

3. A material for the electrostatic data recording according to claim 2, wherein the dielectric layer contains said mixed silicon and titanium oxide modified with hexamethyltricyclosiloxane.

4. A material for the electrostatic data recording according to claim 2, wherein said dielectric layer contains said mixed silicon and titanium oxide modified with octamethyltetracyclosiloxane.

5. A material for the electrostatic data recording according to claim 2, wherein the dielectric layer contains said mixed silicon and titanium oxide modified with a mixture of hexamethyltricyclosiloxane and octamethyltetracyclosiloxane.

6. A material for the electrostatic data recording according to claim 1, wherein the polymeric binder in the dielectric layer is a polymer selected from the group consisting of vinyl, acryl, alkyd and styrene polymers.

* * * * *